US007152250B2

(12) United States Patent
Phillip, Sr.

(10) Patent No.: US 7,152,250 B2
(45) Date of Patent: Dec. 26, 2006

(54) FLIP BRIM HAT

(76) Inventor: Michael Phillip, Sr., 34 Pemberton Dr., Matawan, NJ (US) 07747

( * ) Notice: Subject to any disclaimer, the term of this patent is extended or adjusted under 35 U.S.C. 154(b) by 51 days.

(21) Appl. No.: 10/946,898

(22) Filed: Sep. 22, 2004

(65) Prior Publication Data

US 2005/0193474 A1 Sep. 8, 2005

Related U.S. Application Data

(60) Provisional application No. 60/546,776, filed on Feb. 23, 2004.

(51) Int. Cl.
*A42B 1/00* (2006.01)

(52) U.S. Cl. ..... 2/195.1

(58) Field of Classification Search ..... 2/10, 2/181, 182.1, 183, 209.7, 195.1, 209.13
See application file for complete search history.

(56) References Cited

U.S. PATENT DOCUMENTS 3,237,203 A * 3/1966 Nielsen ..... 2/10
3,555,562 A * 1/1971 Patton, Jr. ..... 2/10
4,536,892 A * 8/1985 Brinkhoff et al. ..... 2/424
5,692,234 A * 12/1997 Yuen ..... 2/10
5,819,318 A * 10/1998 Tse ..... 2/182.1
5,966,738 A * 10/1999 Wang Lee ..... 2/10
6,807,679 B1 * 10/2004 Wang-Lee ..... 2/10

* cited by examiner

*Primary Examiner*—Katherine M. Moran
(74) *Attorney, Agent, or Firm*—National IP IP Rights Center

(57) ABSTRACT

An adjustable hat comprising: a material crown; a first axis situated on a first side of said crown; a second axis situated on a second side of said crown; a brim containing a frame having a first end and a second end; said first end engaging said first axis and said second end engaging said second axis, said brim being rotatably positioned about said material crown.

4 Claims, 4 Drawing Sheets

FLIP BRIM HAT

FIELD OF THE INVENTION

The present invention relates generally to a hat with a moveable brim. In particular the invention relates to a hat with a brim segment that is hingedly attached to a crown segment. This patent claims priority to U.S. Patent No. 60/546,776 filed Feb. 23, 2004.

BACKGROUND OF THE INVENTION

There have been many uses for hats through the years as a hat often serves a dual purpose of providing protection from the elements and providing a fashionable accessory to a person's attire.

Recently, affordable ball caps have been widely adapted as they also provide a team, brand, or product insignia and therefore signal sports fan allegiance, brand allegiance, or product awareness. Users of a ball cap also utilize the positioning of a cap as a means of self expression. The way in which a cap is positioned on a wearers head in addition to the particular insignia and style of hat chosen by the wearer is an effective way to engage in the expression of style.

A ball cap is also functional and effective in blocking the sun from a wearer's eyes. However, there are many situations where a user desires a cap to be adjustable in configuration both for style and for function. There have been many improvements on the basic hat design.

U.S. Pat. No. 4,777,667 discloses a flip cap that intermittently displays an informative or advertising message through the use of a hinged bill cap.

U.S. Pat. No. 5,533,211 discloses a hat with an interior track member that allows the brim to be horizontally rotated around the crown of the hat to various positions.

U.S. Pat. No. 5,715,534 also discloses an interior channel for slidable positioning of one or more hat brims around the crown.

U.S. Pat. No. 5,870,772 also discloses a hat brim that can be rotated about the crown.

None of the foregoing patents provide a hat with a brim that can be re-positioned vertically about the crown of the hat.

OBJECTS OF THE INVENTION

It is an object of the present invention to provide a hat with a brim that can be adjustably positioned about the crown of the hat. It is a further object of the invention to provide a hinged positioning mechanism that provides a multiplicity of set points for a brim of a hat.

SUMMARY OF THE INVENTION

The invention is defined by the appended claims with a specific embodiment shown in the attached drawings. For the purpose of summarizing the invention, the invention comprises a hat with a vertically hinged brim. The brim is formed with two frame ends that engage each of two axes formed on opposite sides of the crown of the hat and allow the brim of the hat to be rotatably positioned about the crown portion of the hat. The hat brim can be adjusted to a front horizontal position, a rear horizontal position, or numerous different vertical positions. In a preferred embodiment, the two axes are adjustably seated in a plurality of positions when engaged by the frame ends. The axes receive the frame ends and establish the various positions of the brim through friction fit or other means. The invention can also be practiced with just one axis and frame end.

In a preferred embodiment, the brim of the hat is formed with a frame that is formed of a single metallic piece and has one end protruding from each side of the bill of the hat. In another embodiment of the invention, the two frame ends are formed of two separate pieces of plastic. One frame end is embedded in each side of the brim of the hat.

In another preferred embodiment of the invention, the axes are engaged by a housing member that also receives the frame ends. The housing member is hollow and receives the frame ends. There is one housing member positioned on each side of the crown and the first end of the housing is positioned over the axis on each side of the crown. The second end of the housing receives the frame end on each side of the crown.

In another preferred embodiment of the invention, the housing member contains a positioning mechanism that is actuated by insertion of a frame end. The housing member allows for limited axial movement of the frame end into and out of the housing member. The frame end is preferably tensioned towards the axis. This is preferably accomplished with the use of a spring attached to the interior of the housing and the frame end. When the frame end is moved away from the axis, the positioning mechanism is disengaged allowing for free movement of the brim about the crown of the hat. When the frame end is moved towards the axis, the positioning mechanism is engaged and secures the position of the brim relative to the crown. The positioning mechanism can be achieved through a variety of means known in the art, but in one particular embodiment, a tab is disposed in the interior of the housing member. The tab has an inward bias towards the interior of the housing member. The tab is forced out of the housing member by the frame end whereby it engages the radial grooves on the washer and effectively fixes the brim in a desired position. In this particular embodiment, the positioning mechanism is provided by the tab and grooves on the washer of the invention.

In still another preferred embodiment of the invention, the frame end engages the axis directly. In this embodiment the user is able to provide a friction fit of the frame end by tightening the fastener into the nut and tightening the fastener head against the frame end and the washer. This is the simplest form of providing a vertically rotatable hinged brim hat with a fastener tightened to secure the position of the brim.

In yet another preferred embodiment of the invention, the frame ends are formed of two separate plastic pieces. The right side frame end is contained within the right side of the brim of the hat. The left side frame end is contained within the left side of the brim of the hat. The construction of the right side and left side are mirror images of each other. The frame end engages the housing second end which is hollow and suited to receive, but not release the frame end. The housing first end contains a hollow cylinder with a tab suited for receiving a fastener. The fastener composes the primary piece of the axis. The fastener is designed with axial grooves at the second end of the fastener. The first end of the fastener is threaded to engage a conventional nut. The fastener is threaded through the housing first end and through the hollow cylinder, then through a washer, the crown of the hat, and finally engages the nut. The fastener, thus connected, provides the axis of rotation of the invention. The notch on the cylinder engages the axial grooves on the fastener and serves as the positioning mechanism.

BRIEF DESCRIPTION OF THE DRAWINGS

The foregoing summary, as well as the following detailed description of a preferred embodiment of the present invention will be better understood when read with reference to the appended drawings, wherein.

DETAILED DESCRIPTION OF THE DRAWINGS

The invention is broadly disclosed as a hat with a vertically hinged brim. Specific embodiments of this invention are presented in the following drawings.

Figure 1:
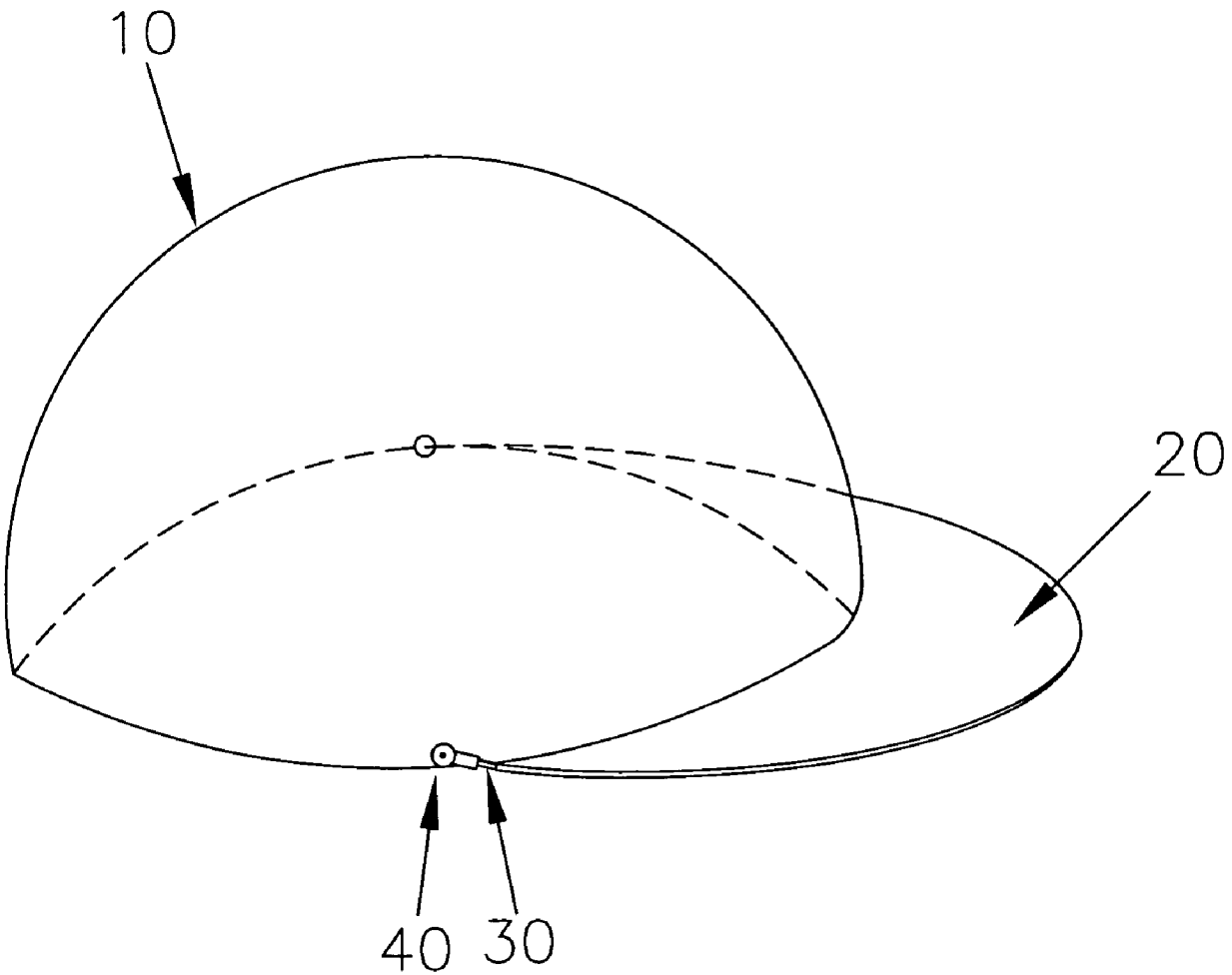
FIG. 1 is a side view of an embodiment of the invention.

FIG. 1 presents a side view of an embodiment of the invention. Material crown 10 is constructed of any readily available material providing either functional, style, or cost advantages. Brim 20 contains right side frame end 30 on the right side. Right side frame end 30 engages right side axis 40. Thus the brim 20 can rotate about axis 40 and about material crown 10. The left side of the hat is a mirror image of the right side of the hat.

Figure 2:
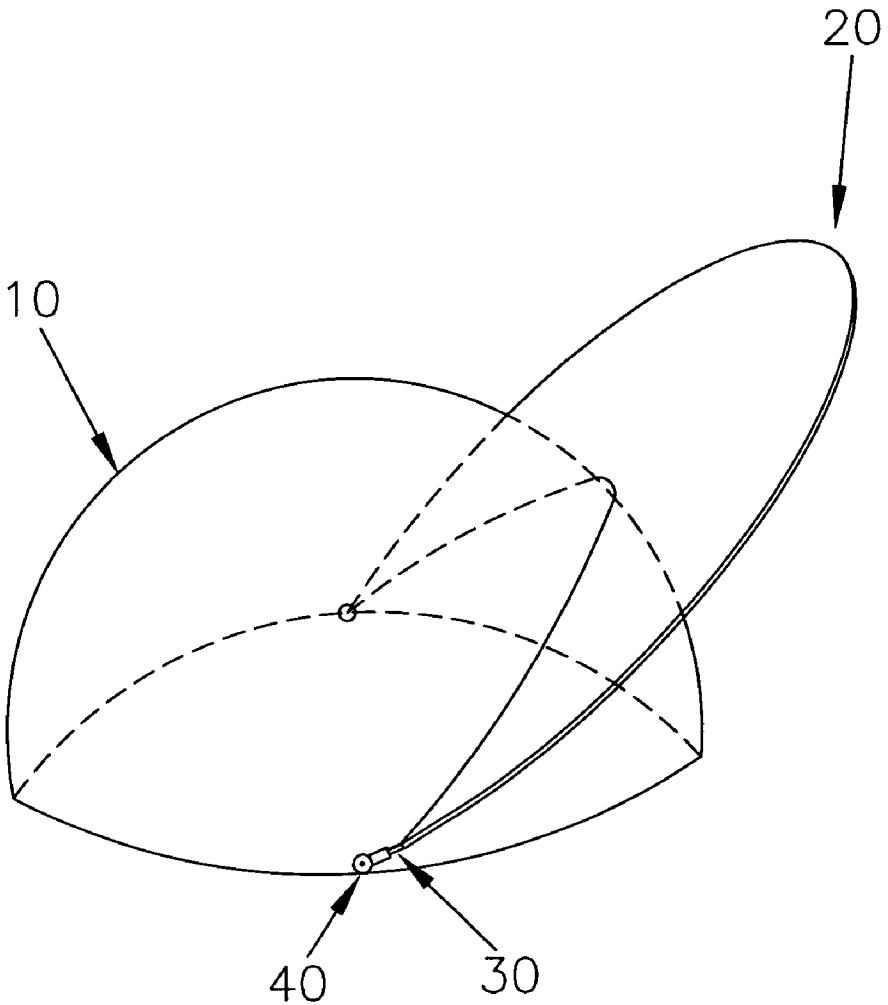
FIG. 2 is a side view of the device of the invention in an alternate position.

FIG. 2 presents a side view where brim 20 is in a vertical position. Crown 10 is fitted with right side axis 40 connected to right side frame end 30. Frame end 30 connects axis 40 with brim 20. The brim of the hat is rotatable about the crown 10. In this embodiment of the invention, the crown 10 is spherical in shape and provides friction against the brim 20 to help keep brim 20 in the desired position.

Figure 3:
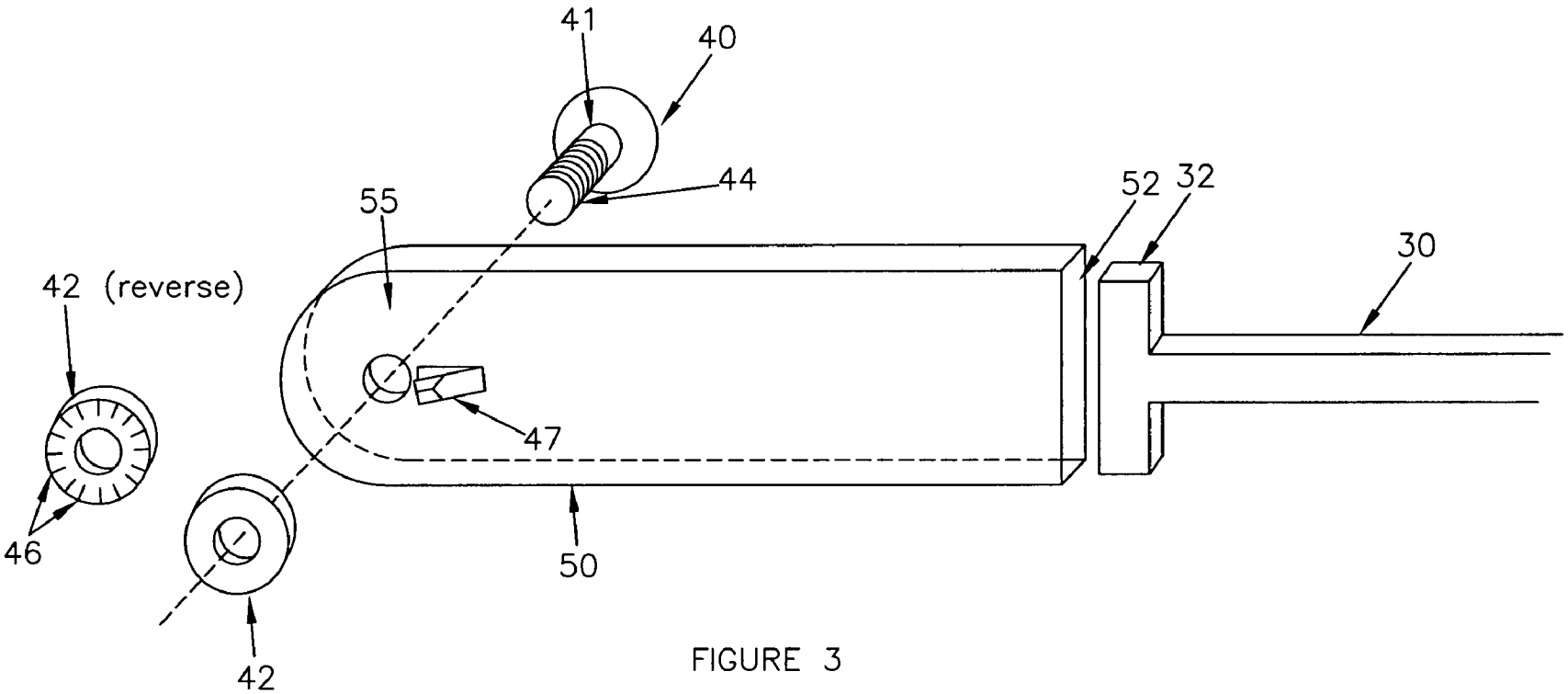
FIG. 3 is a side view of the axis of the invention.

FIG. 3 presents an exploded view of axis 40. In this particular embodiment of the invention, axis 40 is threadedly connected to nut 42. Axis 40 is a threaded fastener with smooth segment 41 and threaded segment 44. Axis 40 passes through housing 50 to engage nut 42. Frame 30 has enlarged frame end 32 inserted into hollow housing second end 52. Housing 50 is hollow. Tab 47 is located at housing first end 55. Tab 47 is biased inwardly but is displaced out of housing 50 when frame end 32 is fully inserted in housing 50. Tab 47 is shown displaced out of the housing. Nut 42 is also shown in reverse to show grooves 46. When assembled, grooves 46 face housing 50 and tab 47. Tab 47 engages multiple grooves 46 on nut 42. Together tab 47 and grooves 46 provide the positioning mechanism of the invention.

Figure 4:
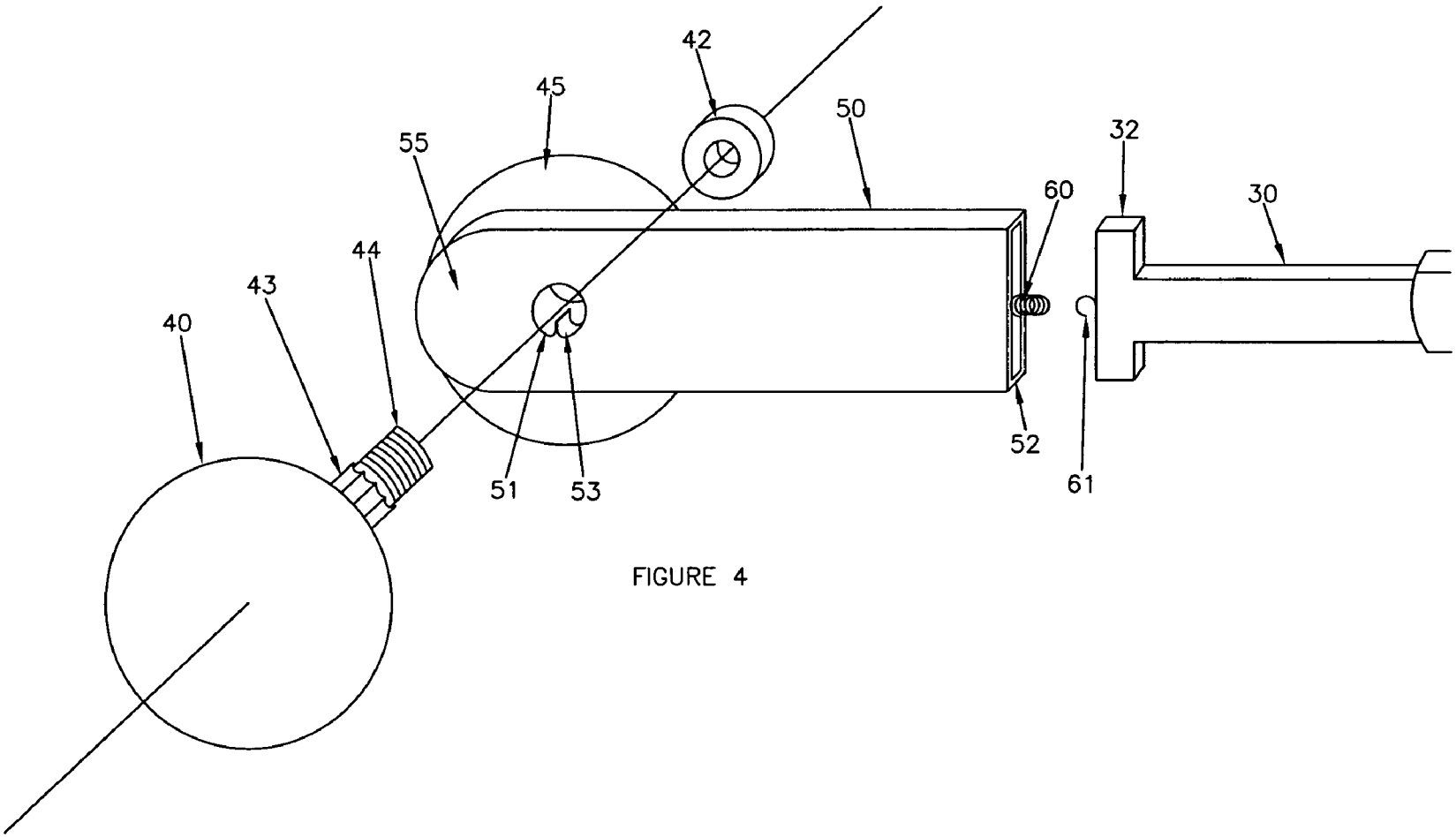
FIG. 4 is a close up view of the housing member of the invention.

FIG. 4 presents an exploded view of another embodiment of the invention comprising a hollow cylinder 51 disposed in the first end 55 of housing 50. Tab 53 is located on the interior of cylinder 51. Axis 40 is a threaded fastener with threaded portion 44 as well as axially grooved portion 43. Threaded portion 44 has significantly smaller diameter than cylinder 51 and the threaded portion 44 passes through cylinder 51 without engaging tab 53. Threaded portion 44 passes through washer 45 and engages interior threaded portion of nut 42. Axially grooved portion 43 has a diameter somewhat smaller than the diameter of cylinder 51. Tab 53 engages the axially grooved portion 43 of axis 40 and provides frictionally stabilized positioning mechanism. The frame end 32 is also biased towards the housing first end 55 by spring 60. Spring 60 is attached to frame end 32 by hook 61. This provides an additional frictional stabilization of the brim of the hat. In order for the user to adjust the hat, the brim is pulled outward away from the axis of the hat thus disengaging the friction of the brim about the crown and rotating the housing 50 and frame 30 about the axis 40. Releasing the brim allows spring 60 to retract the frame end 30 into the housing 50 and provide frictional positioning of the hat.

The invention claimed is:

1. An adjustable hat comprising:

a material crown;

a first axis situated on a first side of said crown;

a second axis situated on a second side of said crown;

a brim containing a first frame end and a second frame end;

said first frame end engaging said first axis and said second frame end engaging said second axis, said brim being rotatably positioned about said material crown; and a positioning mechanism that serves to keep said brim temporarily fixed in one of multiple positions;

said positioning mechanism further comprising a fastener member having axial grooves; and further comprising a hollow cylinder, an interior tab on the interior of the hollow cylinder, said fastener member located within said hollow cylinder, said interior tab engaging said axial grooves.

2. An adjustable hat comprising:

a material crown;

a first axis situated on a first side of said crown;

a second axis situated on a second side of said crown;

a brim containing a first frame end and a second frame end;

said first frame end engaging said first axis and said second frame end engaging said second axis, said brim being rotatably positioned about said material crown; and a positioning mechanism that serves to keep said brim temporarily fixed in one of multiple positions;

said positioning mechanism comprises a first positioning mechanism on said first side of said crown and a second positioning mechanism on said second side of said crown, said first positioning mechanism comprising a first housing having a hollow proximal end receiving said first frame end, said first housing having a distal end situated over said first axis, said first housing distal end containing a first hollow cylinder, said first hollow cylinder having a first interior tab, a first fastener member having axial grooves engaging said first interior tab and said first fastener member having a threaded portion engaging a first nut;

said second positioning mechanism comprising a second housing having a hollow proximal end receiving said second frame end, said second housing having a distal end situated over said second axis, said second housing distal end containing a second hollow cylinder, said second hollow cylinder having a second interior tab, a second fastener member having axial grooves engaging said second interior tab and said second fastener member having a threaded portion engaging a second nut, said first and second positioning mechanisms aiding in positioning the brim of the hat in various positions.

3. An adjustable hat as in claim 2 further comprising a tensioning member attached to said housing and to said frame end.

4. An adjustable hat as in claim 3 wherein said tensioning member is a spring.

* * * * *